US008506324B2

(12) United States Patent
Naufel et al.

(10) Patent No.: US 8,506,324 B2
(45) Date of Patent: Aug. 13, 2013

(54) USB RECEPTACLE WITH A RISER AT ITS END

(75) Inventors: Naufel C. Naufel, Tempe, AZ (US); Christopher M. Madsen, Gilbert, AZ (US)

(73) Assignee: Emerson Network Power—Embedded Computing, Inc., Tempe, AZ (US)

( * ) Notice: Subject to any disclaimer, the term of this patent is extended or adjusted under 35 U.S.C. 154(b) by 0 days.

(21) Appl. No.: 13/325,135

(22) Filed: Dec. 14, 2011

(65) Prior Publication Data

US 2013/0157478 A1 Jun. 20, 2013

(51) Int. Cl.
*H01R 13/66* (2006.01)

(52) U.S. Cl.
USPC ..... 439/541.5

(58) Field of Classification Search
USPC ..... 439/541.5, 59; 361/785, 752, 803
See application file for complete search history.

(56) References Cited

U.S. PATENT DOCUMENTS 5,519,573 A * 5/1996 Cobb et al. ..... 361/679.32
5,851,125 A * 12/1998 Hsu et al. ..... 439/541.5
5,963,431 A * 10/1999 Stancil ..... 361/803
6,183,292 B1 * 2/2001 Chen et al. ..... 439/541.5
6,478,616 B1 * 11/2002 Yeh ..... 439/541.5
6,491,533 B2 * 12/2002 Costello et al. ..... 439/188
7,254,038 B2 * 8/2007 Drako ..... 361/752
7,701,725 B2 * 4/2010 Fan et al. ..... 361/785

OTHER PUBLICATIONS

The Institute of Electrical and Electronics Engineers, Inc., "IEEE Standard for Mechanical Core Specifications for Microcomputers Using IEC 60603-2 Connectors", Dec. 18, 1998, pp. 1-47, New York, NY.

"Embedded Computing Product Guide", Emerson Network Power, 2009.

* cited by examiner

*Primary Examiner* — Chandrika Prasad
(74) *Attorney, Agent, or Firm* — Harness, Dickey & Pierce, P.L.C.

(57) ABSTRACT

A USB receptacle assembly includes a USB receptacle. The receptacle has a first end and a second end opposite the first end. The USB receptacle also includes a USB interface located at the first end. A riser is coupled to the second end of the USB receptacle and is generally perpendicular to a long axis of the USB receptacle. A board connector is coupled to the riser in electrical communication with the USB receptacle.

22 Claims, 9 Drawing Sheets

USB RECEPTACLE WITH A RISER AT ITS END

FIELD

The present disclosure generally relates to multi-service platform system and computer modules.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Printed circuit boards are frequently built as modules which are inserted to a multi-service platform system. The modules are predominately circuit boards, which are fitted with a large number of electronic components. On their inboard ends, the modules have connectors which are mated with corresponding counter-connectors when inserted into a holding fixture. These connectors may be, for example, coaxial connectors or circuit boards with a large number of blade contacts.

A computer module typically includes a faceplate. Various connectors (e.g. Universal Serial Bus (USB) receptacles, mini D-Sub connectors), switches, and indicator lights are provided in the faceplate. The computer modules are typically designed to conform to one or more industrial standards (such as VPX/VITA 46). Considering the limited physical surface area of the faceplate and other design requirements commanded by various industry standards, arrangement of the connectors, switches, and indicator lights on the faceplate can present various design challenges.

SUMMARY

A USB receptacle assembly including a USB receptacle having a first end, a second end opposite the first end, and a USB interface located at the first end. A riser is coupled to the second end of the USB receptacle and is generally perpendicular to a long axis of the USB receptacle. A board connector is coupled to the riser and in electrical communication with the USB receptacle.

A computer board assembly including a circuit board having connectors located at an inboard end of the circuit board and configured to be coupled to a slot of a backplane. A USB receptacle has a first end, a second end opposite the first end, and a USB interface includes a first flange disposed at the first end. A riser is coupled to the second end of the USB receptacle at a first end of the riser. A board connector is coupled to an outboard end of the circuit board and a second end of the riser. The board connector electrically communicates with the USB receptacle and the circuit board. An electrically conductive element is coupled to the circuit board and positioned between the USB receptacle and the circuit board. A retention bracket engages the USB receptacle and is positioned inboard of and adjacent to the flange.

A computer module includes a circuit board and a faceplate coupled to the circuit board. The faceplate has first and second adjacent apertures positioned along a width of the faceplate. A USB receptacle has a first end and a second end, with a USB interface and a first flange are disposed in proximity to the first end. A riser is coupled to the second end of the USB receptacle at the first end. A board connector is coupled to the circuit board and a second end of the riser. The board connector is in electrical communication with the USB receptacle and the circuit board. An I/O connector is coupled to the circuit board and positioned between the USB receptacle and the circuit board, and a portion of the I/O connector is placed in the second aperture. The computer module also includes a retention bracket and a fastener. A portion of the flange is placed generally within the first aperture, and the retention bracket engages the USB receptacle and is arranged adjacent to an inboard face of the faceplate and covers a portion of the first aperture. The retention bracket and the first aperture restrict movement of the flange, and the fastener secures the retention bracket to the faceplate.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
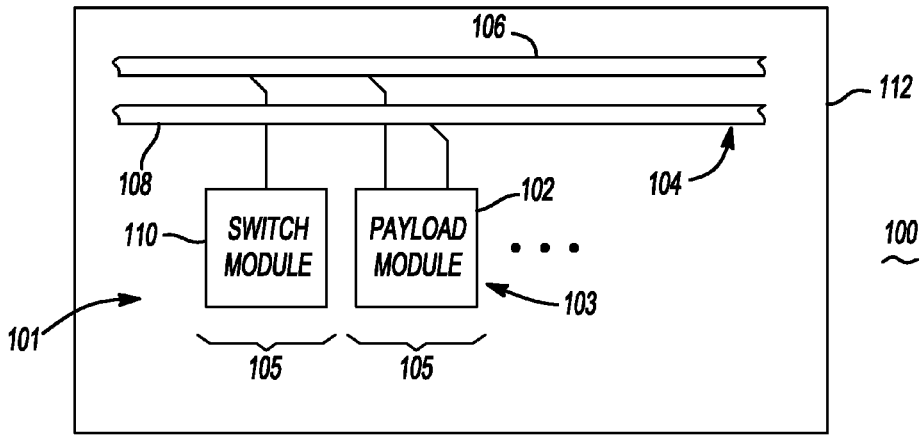
FIG. 1 depicts a multi-service platform system according to certain embodiments of the disclosure.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

Terms for describing spatial arrangement, such as over, above, under, below, laterally, right, left, obliquely, back, and front, are often used for briefly showing, with reference to a diagram, a relation between an element and another element or between some characteristics and other characteristics. Note that embodiments of the present disclosure are not limited thereto, and such terms for describing spatial arrangement can indicate not only the direction illustrated in a diagram but also another direction. For example, when it is explicitly described that B is over A, it does not necessarily mean that B is placed over A, and can include the case where B is placed under A because a device in a diagram can be inverted or rotated by 180 degree. Accordingly, over can refer to the direction described by under in addition to the direction described by over. Note that embodiments of the present disclosure are not limited thereto, and over can refer to other directions described by laterally, right, left, obliquely, back, and front in addition to the directions described by over and under because a device in a diagram can be rotated in a variety of directions.

FIG. 1 depicts a multi-service platform system 100 according to certain embodiments of the disclosure. The multi-service platform system 100 can include a computer chassis 112, with software and any number of slots 105 for inserting a computer module 101 (to be described herein) such as a 3U module 103, which can be, for example and without limitation, a payload module 102, a switch module 110, and the like. Computer module 101 can provide functionality to multi-service platform system 100 through the addition of processors, memory, storage devices, device interfaces, network interfaces, and the like. In certain embodiments, a backplane connector is used for connecting computer modules placed in the slots. In certain embodiments, the multi-service platform system 100 is an embedded, distributed processing computer system.

In certain embodiments, 3U module 103 can refer to a module or expansion card that has a 3U form factor, which includes physical dimensions, electrical connections, and the like. As is known in the art, "U" and multiples of "U" refer to the height (assuming a vertical mounting orientation) of a module or expansion card. In certain embodiments, "U" can measure approximately 1.75 inches. Therefore, 3U module 103 can measure approximately 3U in height. 3U module 103 can have its own specific set of electrical connections to interface with a backplane 104 of the computer chassis 112. As an example of an embodiment, multi-service platform system 100 can include the computer chassis 112 and one or more 3U modules conforming to the VPX/VITA 46 standard as set forth by VMEbus International Trade Association (VITA), P.O. Box 19658, Fountain Hills, Ariz., 85269. In certain embodiments, multi-service platform system 100 may include a packet switched network, known as a switched fabric 106 and a VMEbus network 108, both located on backplane 104.

In certain embodiments, multi-service platform system 100 can be controlled by a platform controller (not shown for clarity), which can include a processor for processing algorithms stored in memory. Memory comprises control algorithms, and can include, but is not limited to, random access memory (RAM), read only memory (ROM), flash memory, electrically erasable programmable ROM (EEPROM), and the like. Memory can contain stored instructions, tables, data, and the like, to be utilized by processor. Platform controller can be contained in one, or distributed among two or more payload modules with communication among the various modules of multi-service platform system 100.

In certain embodiments, the VMEbus network 108 is a parallel multi-drop bus network that is known in the art. The VMEbus network 108 is defined in the ANSI/VITA 1-1994 and ANSI/VITA 1.1-1997 standards, promulgated by the VMEbus International Trade Association (VITA), P.O. Box 19658, Fountain Hills, Ariz., 85269 (where ANSI stands for American National Standards Institute). In certain embodiments of the disclosure, the VMEbus network 108 can include VMEbus based protocols such as Single Cycle Transfer protocol (SCT), Block Transfer protocol (BLT), Multiplexed Block Transfer protocol (MBLT), Two Edge VMEbus protocol (2 eVME) and Two Edge Source Synchronous Transfer protocol (2eSST). VMEbus network 108 is not limited to the use of these VMEbus based protocols and other VMEbus based protocols are within the scope of the disclosure.

In certain embodiments, switched fabric 106 can use switch module 110 as a central switching hub with any number of payload modules 102 coupled to switch module 110. Switched fabric 106 can be based on a point-to-point, switched input/output (I/O) fabric, whereby cascaded switch devices interconnect end node devices. Although FIG. 1 depicts switched fabric 106 as a bus for diagrammatic ease, switched fabric 106 may in fact be a star topology, mesh topology, and the like as known in the art for communicatively coupling switched fabrics. Switched fabric 106 can include both module-to-module (for example computer systems that support I/O module add-in slots) and chassis-to-chassis environments (for example interconnecting computers, external storage systems, external Local Area Network (LAN) and Wide Area Network (WAN) access devices in a data-center environment). Switched fabric 106 can be implemented by using one or more of a plurality of switched fabric network standards, for example and without limitation, InfiniBand®, Serial RapidIO®, FibreChannel®, Ethernet®, PCI Express®, Hypertransport® and the like. Switched fabric 106 is not limited to the use of these switched fabric network standards and the use of any switched fabric network standard is within the scope of the disclosure.

Multi-service platform system 100 can include any number of payload modules 102 and switch modules 110 coupled to the backplane 104. The backplane 104 can include hardware and software necessary to implement a VMEbus network 108 and a switched fabric 106.

Figure 2:
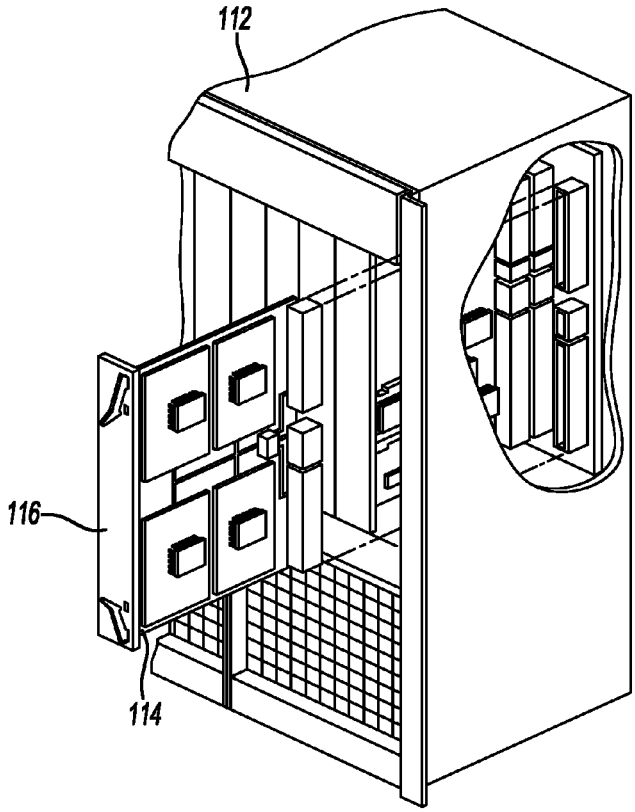
FIG. 2 is a block diagram of a multi-service platform system according to certain embodiments of the disclosure.

FIG. 2 depicts multi-service platform system 100 in accordance with certain embodiments of the present disclosure. As shown in FIG. 2, computer chassis 112 is designed to receive one or more computer modules 101. Each computer module 101 can be inserted into, and interface with, computer chassis 112 via a slot 105. Computer chassis 112 can be designed to receive any number of computer modules 101. Computer module 101 can include one or a number of circuit boards 114, on which can be mounted various electronic circuit components, for example and without limitation, a printed circuit board (PCB). Circuit board 114 can be sheet metal, plastic and the like. In another embodiment, circuit board 114 can be a PCB. A faceplate 116 is coupled to circuit board 114. In certain embodiments, backplane computer chassis 112 and computer module 101 each have a set of interlocking connectors designed to mate when computer module 101 is placed in slot 105. Backplane 104 can be used for interconnecting computer modules 101.

In certain embodiments of the disclosure, computer module 101 can be an Advanced Telecommunications Computer Architecture (AdvancedTCA®) module having an AdvancedTCA form factor. AdvancedTCA form factor, including mechanical dimensions, electrical specifications, and the like, are known in the art and set forth in the AdvancedTCA Specification, by PCI Industrial Computer Manufacturers Group (PCIMG), 301 Edgewater Place, Suite 220, Wakefield, Mass.

In certain embodiments, computer module 101 can be a VMEbus computer module having a VMEbus form factor. VMEbus form factor, including mechanical dimensions, electrical specifications, and the like are known in the art and set forth in the ANSI/VITA 1-1994 and ANSI/VITA 1.1-1997 standards promulgated by the VMEbus International Trade Association (VITA), P.O. Box 19658, Fountain Hills, Ariz., 85269 (where ANSI stands for American National Standards Institute).

In certain embodiments, computer module 102 can be a CompactPCI board having a CompactPCI form factor. CompactPCI form factor, including mechanical dimensions, electrical specifications, and the like, are known in the art and set forth in the CompactPCI Specification, by PCI Industrial Computer Manufacturers Group (PCIMG™), 301 Edgewater Place, Suite 220, Wakefield, Mass. In still yet another embodiment, computer module 102 can be an Advanced Packaging System (APS) board having an APS form factor. APS form factor, including mechanical dimensions, electrical specifications, and the like, are known in the art and set forth in the ANSI/VITA Specification 34.

Figure 3:
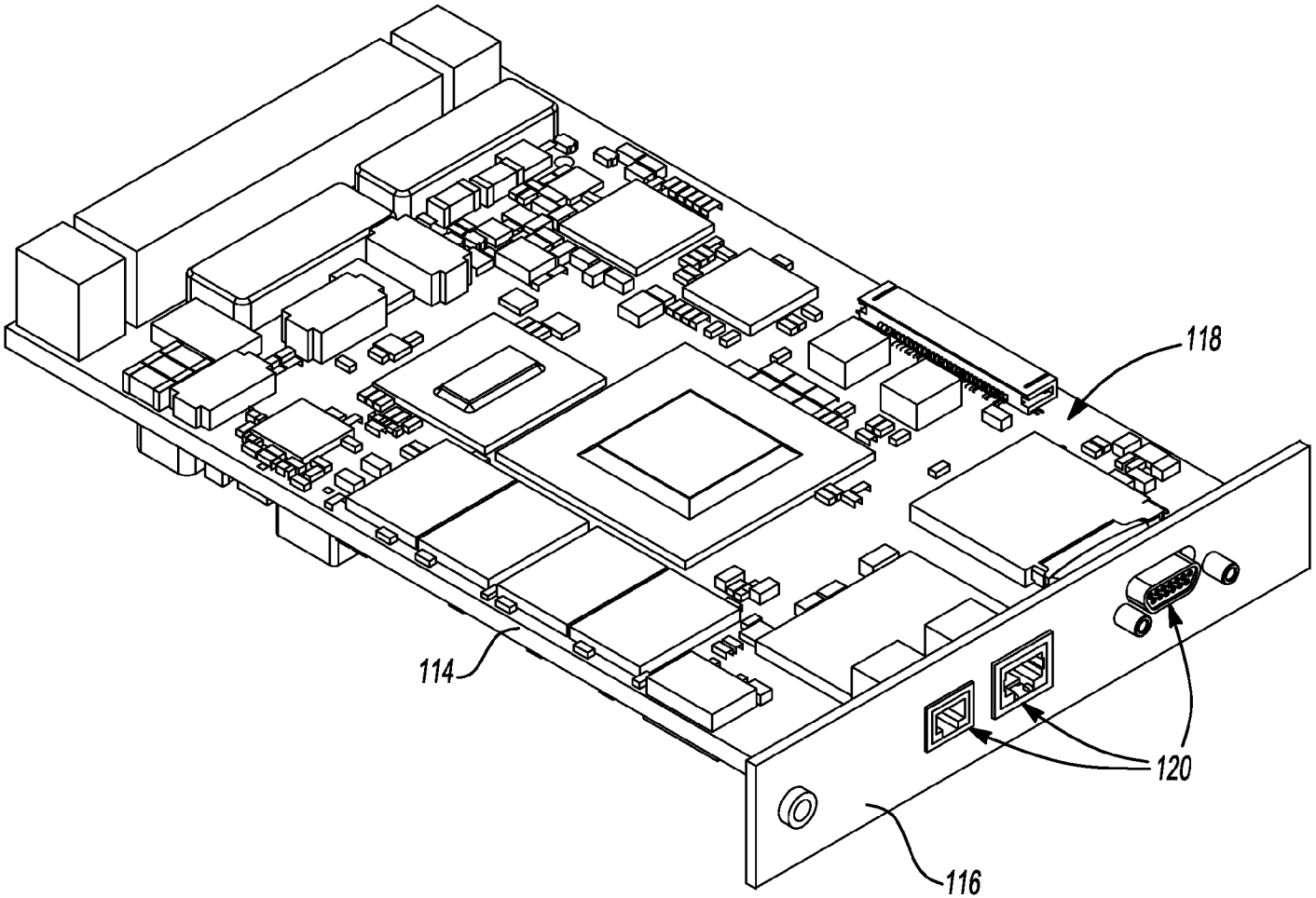
FIG. 3 depicts a computer module according to certain embodiments of the disclosure.

FIG. 3 depicts computer module 101 in certain embodiments. Computer module 101, which can be a node board, a fabric board, or a blade server, includes a circuit board 114 and a faceplate 116 that is attached to the circuit board 114 at an outboard edge 118 of circuit board 114. Faceplate 116 can be a rectangular, flat panel and generally perpendicular to circuit board 114. Faceplate 116 can be made of, for example, sheet metal or plastic. In certain embodiments, circuit board 114 can be a structural member onto which a PCB is mounted. In certain embodiments, circuit board 114 can be a PCB. Faceplate 116 can include a number of connectors, switches, indicator lights and the like 120 that interface with electronic elements on circuit board 114. For example, faceplate 116 can include apertures for accommodating a USB, mini D-sub, or other I/O connectors. Various electronic components are coupled to circuit board 114. For example, a processor, memory, and supporting circuitry can be included to implement predetermined computational or switching functionalities.

Depending on the specification to which computer module 101 is designed, computer module 101, and accordingly faceplate 116, will have specific physical dimensions. For example, to conform to the VPX/VITA 46 standard, computer module 101 may have a 3U, 6U, or 9U form factor. Accordingly, faceplate 116 of computer module 101 has a width w along direction x of approximately 1.0 inch (referred to herein as a VPX width) and a height along direction y of approximately 3U, 6U or 9U. Various connectors, switches, indicator lights 120 can be arranged along a longitudinal direction of the faceplate and form a single row.

As technologies advance, specifications may require a greater number of components be included on circuit board 114. Accordingly, more connectors, switches, and indicator lights 120 may require arrangement on faceplate 116 to interface with the components on circuit board 114. In order to conform to a predetermined specification, the physical dimensions of computer module 101 and its faceplate typically cannot be changed. In addition, many of the connectors and switches 120 are also manufactured in accordance with industry standards, and thus their physical dimensions typically also cannot be changed. The shown single row arrangement of elements 120 on faceplate 116 limits the number of elements 120. After reaching that limitation, no more connectors or switches can be added to faceplate 116 under that arrangement.

Figure 4:
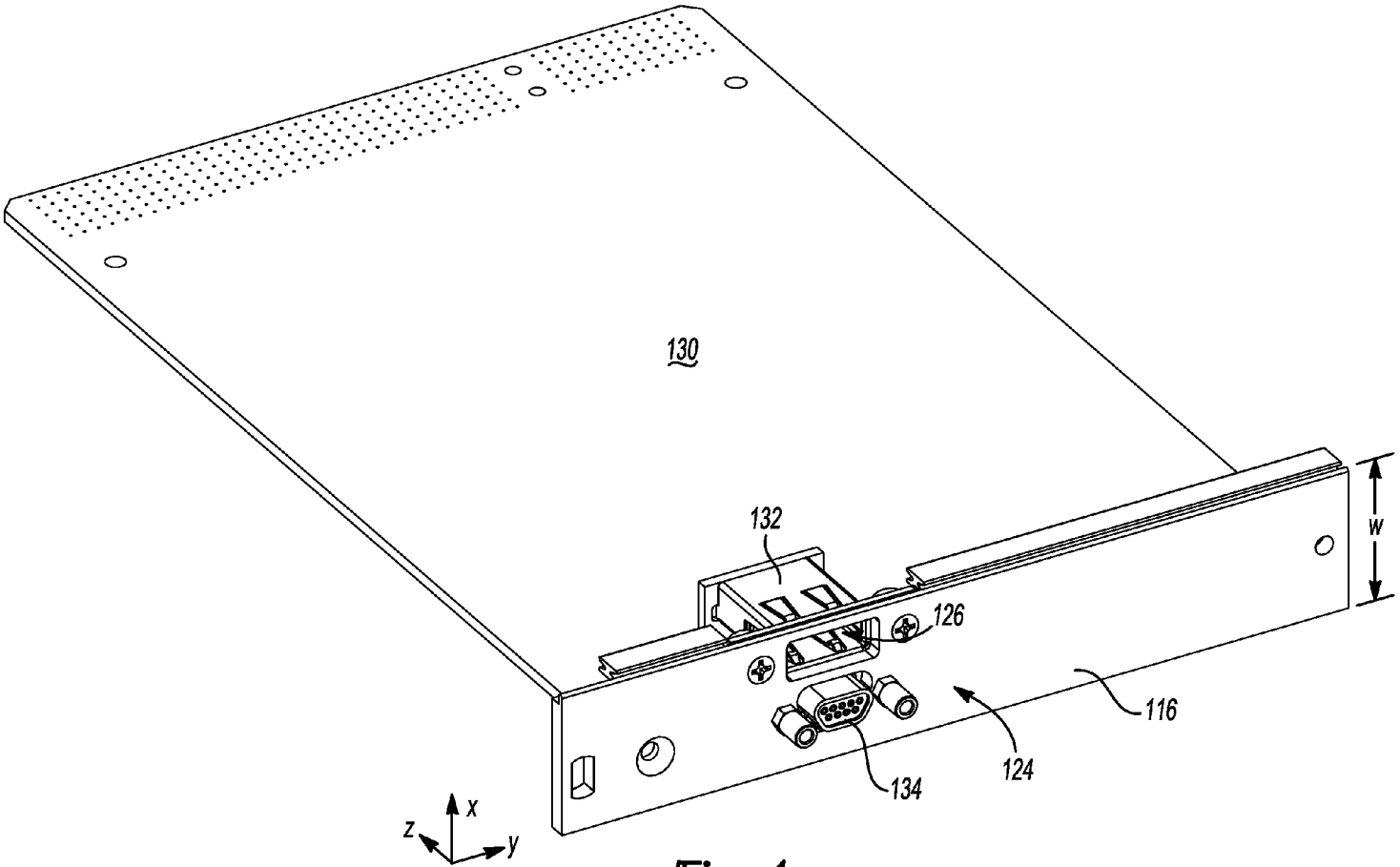
FIG. 4 depicts another computer module according to certain embodiments of the disclosure.

FIGS. 4-12 depict an arrangement of connectors in certain embodiments of the present disclosure. In this arrangement, a pair of connectors 124 can be stacked together in the width w direction x of faceplate 116. Although the term stacked is used here to simplify description, it should be understood that the present disclosure does not imply that the two connectors be in direct physical contact with each other. Rather, the term stacked is generally used to describe a spatial relationship of two elements where one element is adjacent the other element in a predetermined orientation. By way of example, the pair of connectors 124 are placed along the width w direction x of faceplate 116 and are placed adjacent to each other. Each connector 124 has an interface 126 generally included in faceplate 116. The pair of connectors 124 can be arranged in a column transverse to the longitudinal direction y of faceplate 116. Faceplate 116 can also include multiple pairs of stacked connectors arranged along the longitudinal direction y of faceplate 116. In certain embodiments, the outboard end of each interface 126 has a long axis generally parallel to the longitudinal direction y of the faceplate and the plane 130 of the circuit board. This stacked arrangement can increase the number of connectors, switches, and indicator lights 120 included in a faceplate 116. The present disclosure does not limit what type of elements 120 can be stacked. FIG. 4 depicts, by way of non-limiting example, that a USB receptacle 132 is stacked on top of a mini D-Sub connector 134.

Figure 5:
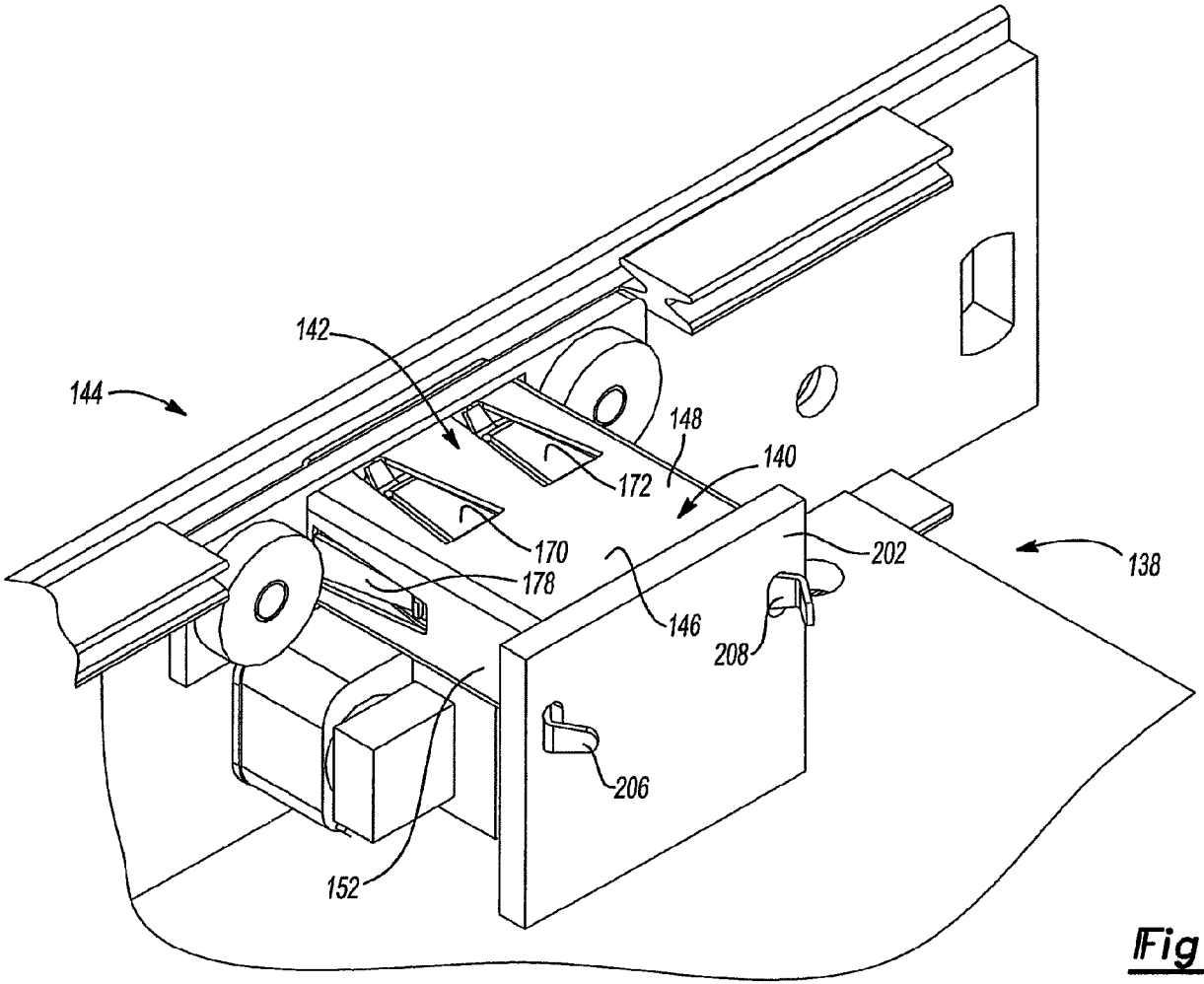
FIG. 5 depicts a rear or inboard perspective view of a USB receptacle assembly according to certain embodiments of the disclosure.
Figure 6:
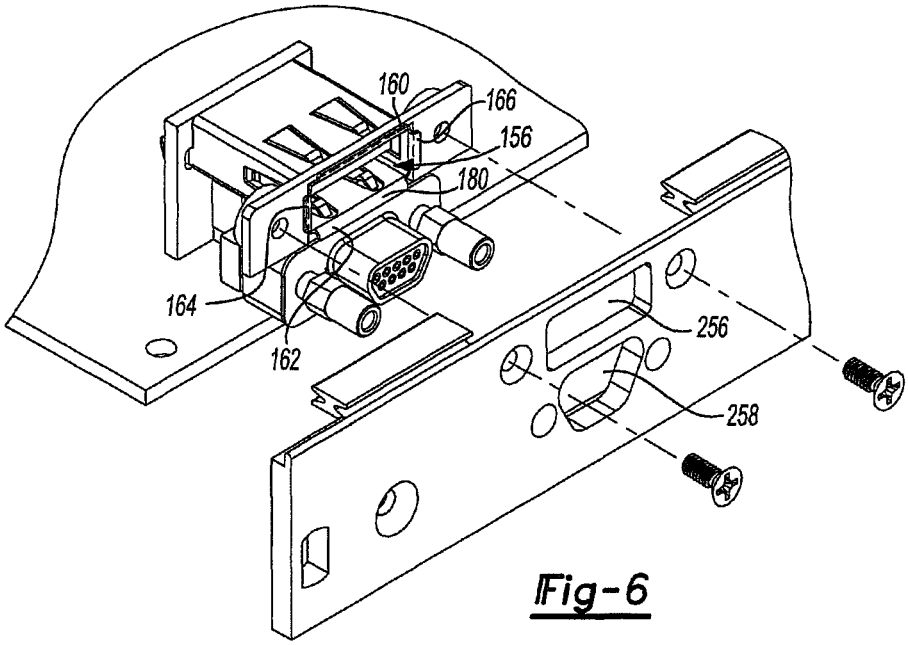
FIG. 6 depicts a partially exploded view of a USB receptacle assembly according to certain embodiments of the disclosure.
Figure 7:
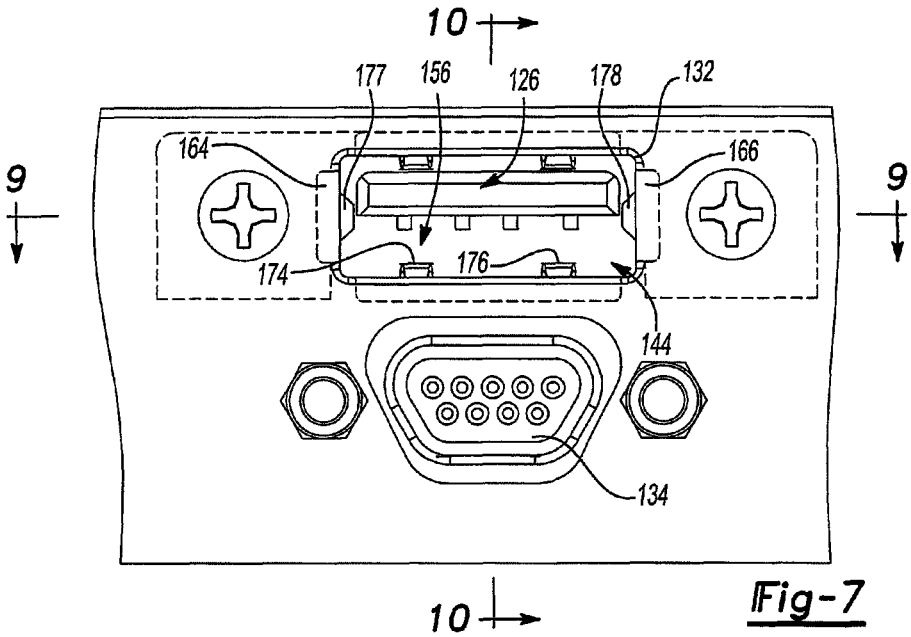
FIG. 7 depicts a front view of a USB receptacle assembly according to certain embodiments of the disclosure.

FIG. 5 depicts a rear perspective view of a USB receptacle assembly 138 having a USB receptacle 132 elevated away from a circuit board to enable placement above another connector in accordance with certain embodiments. USB receptacles are manufactured by various manufactures in accordance with USB specifications such as USB 1.1 and 2.0 specifications. FIG. 5 shows as an example a USB Series A receptacle 132. USB receptacle 132 has an inboard end 140 and an outboard end 142. USB receptacle 132 includes a USB interface 144 at its outboard end 142. USB receptacle 132 has an outer conductive shield 146. Outer conductive shield 146 includes a top wall 148, a bottom wall 150 and two opposed lateral walls 152, 153. USB receptacle 132 has a plug receiving space 156 at outboard end 142. Top wall 148 includes a top flange 160, and two longitudinal springs 170, 172 disposed inwardly toward plug receiving space 156. The bottom wall 150 includes a bottom flange 162 and two longitudinal springs 174, 176 disposed inwardly toward plug receiving space 156. Springs 170, 172, 174, 176 bear against a plug (not shown) inserted in the plug receiving space 156. The two lateral walls 152 and 153 include, respectively, lateral flanges 164 and 166 and longitudinal springs 177, 178 disposed inwardly to bear against the lateral sides of the plug upon inserting. Flanges 160, 162, 164, 166 extend outwardly away from the USB receptacle 132 in a plane generally parallel to faceplate 116. Four flanges 160, 162, 164, 166 each have an outboard face 180 and an inboard face 182. Outboard end 142 of the USB receptacle 132 is received by faceplate 116, as will be described in greater detail below. As is known to those skilled in the art, USB receptacle 132 has multiple connector terminals extending between inboard and outboard ends along USB receptacle 132.

FIGS. 5-10 depict USB receptacle 132 mounted to riser 200 at an upper end 202 using mounting legs 206, 208. Riser 200 generally has a planar shape and can be made of, for example, fiberglass. Mounting legs 206, 208 extend through and engage riser 200 to provide secure attachment.

In certain embodiments, USB receptacle assembly 138 has a board connector 210 that connects riser 200 with circuit board 114. Board connector 210 is in electrical communication with USB receptacle 132 and circuit board 114. Board connector 210 can, for example, include a straight type header connector 212 and a right angle type socket connector 214. Header connector 212 has a header housing 216 and header pins 218 (male contacts) for signal transmission. Header pins 218 are arranged in a plurality of rows on header housing 216. Socket connector 214 is placed on top of the header connector 212 and connected to header connector 212. Contacts of the sockets connector 214 are arranged to correspond to header pins 218 of header connector 212. Header connector 212 is connected to or mounted on circuit board 114, and header pins 218 are coupled to circuit board 114 for signal transmission. Socket connector 214 is connected to or mounted on riser 200 at lower end 223 of riser 200. Socket connector 214 is coupled to riser 200 and/or the USB receptacle 132 in a conventional manner.

Figure 8:
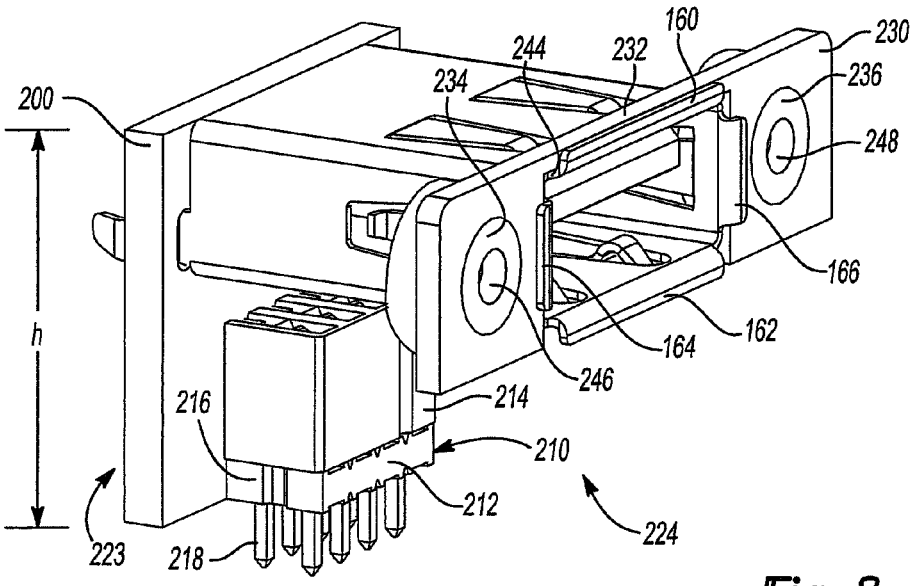
FIG. 8 depicts an outboard perspective view of a USB receptacle assembly according to certain embodiments of the disclosure.

Board connector 210 transmits signals between USB receptacle 132 and circuit board 114. Signals received by the USB receptacle 132 can be transmitted to board connector 210, and signals received by board connector 210 are transmitted to USB receptacle 132. Board connector 210 is generally perpendicular to both riser 200 and circuit board 114. Riser 200 is generally perpendicular to circuit board 114 and forms a generally L shape with circuit board 114. As shown in FIG. 8, in certain embodiments, board connector 210 and USB receptacle 132 are on the same side of the riser 200. Board connector 210 can have a 2 mm×2 mm through-hole socket and a 2 mm×2 mm header. In certain other embodiments, USB receptacle 132 and board connector 210 are arranged on different sides of the riser.

Riser 200 is designed to have a height h that varies in accordance with the width w along direction x of the faceplate 116 and the position of circuit board 114 relative to faceplate 116. Riser 200 elevates USB receptacle 132 to a position on top of a second connector such as a mini D-Sub connector 134 shown FIGS. 8 and 10. In other words, USB receptacle 132 and second connector 134 can be stacked. USB receptacle 132 and riser 200 form a right angle and cover a space 224 adjacent to riser 200 and beneath USB receptacle 132. Second connector 134 is able to be placed in space 224. Riser 200 elevates the USB receptacle 132 to a predetermined height relative to circuit board 114 such that both interfaces of USB receptacle 132 and second connector 134 can be included in faceplate 116 along the width w direction x of faceplate 116. For example, for a computer module 101 that conforms to the VPX/VITA 46 standard, in order to stack a USB receptacle 132 on top of a mini D-Sub connector 134, riser 200 can have a height of 0.569 inches.

Planar retention bracket 230 is formed in a U-shape in certain embodiments. Retention bracket 230 has two side portions 234, 236 and a top portion 232. Top portion 232 is approximately the width of USB receptacle 132 and connects the two side portions 234, 236. Lower edge 238 of top portion 232 and inner edges 240, 242 of respective side portions 234, 236 define an area that approximately has the dimensions corresponding to USB receptacle 132. Retention bracket 230 can be arranged to accommodate USB receptacle 132 at outboard end 142 of USB receptacle 132 and adjacent to flanges 160, 162, 164, 166 of USB receptacle 132. Outboard faces 244 of top portion 232 and side portions 234, 236 of the retention bracket engage with inboard faces 182 of top flange 160 and lateral flanges 164, 166, respectively. Each of side portions 234, 236 of retention bracket 230 has a bore 246, 248. As will be described in more detail later, fasteners can be inserted through the bores 246, 248 in order to secure the USB receptacle assembly 138 with faceplate 116. Retention bracket 230 can be made of sheet metal and have a thickness less than 1 mm.

Figure 12:
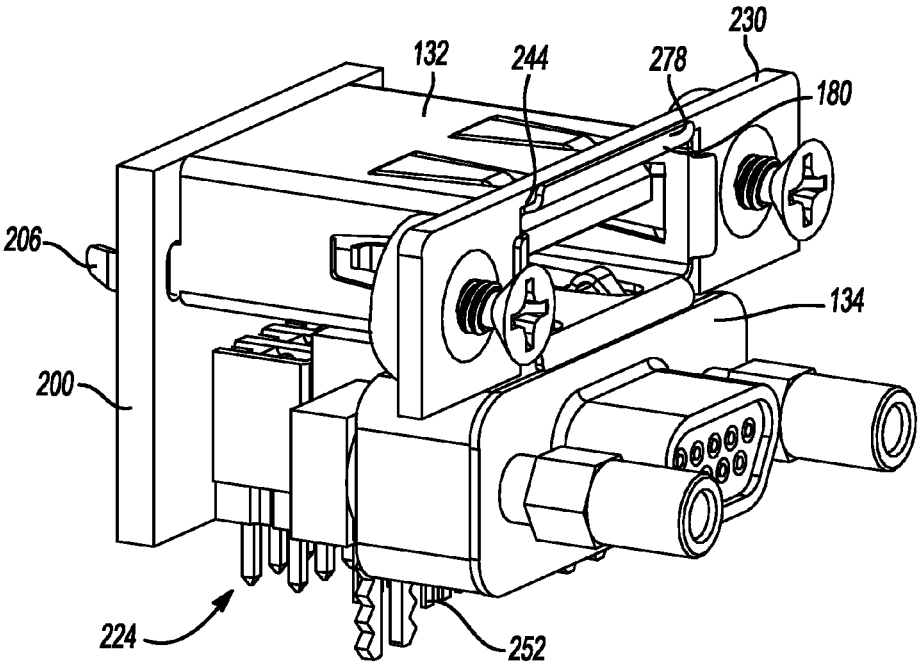
FIG. 12 depicts an outboard perspective view of a USB receptacle assembly according to certain embodiments of the disclosure.

USB receptacle assembly 138 is arranged to accommodate mini D-Sub connector 134. Although mini D-Sub connector 134 is shown in the Figures, one skilled in the art will recognize that I/O connectors, or other elements, can be similarly arranged in space 224 beneath USB receptacle 132. As shown in FIG. 12, the USB receptacle 132, the riser 200, and the board connector 210 partially define a space 224 that is sufficient to place the mini D-Sub connector 134 in space 224. In other words, mini D-Sub connector 134 fits under USB receptacle 132. Mini D-Sub connector 134 can be electrically coupled to the circuit board 114 in a traditional manner. As shown in FIG. 12, mini D-Sub connector 134 has pins 252 under the bottom of its base portion. Using the pins, mini D-Sub connector 134 can be mounted and coupled to circuit board 114. Thus, mini D-Sub connector 134 is in electrical communication with circuit board 114.

FIGS. 9-12 depict a computer module 101 having stacked USB receptacle 132 and mini D-Sub connector 134 in accordance with certain embodiments of the present disclosure. As described above, I/O connectors, or electronic elements, other than a mini D-Sub connector 134 can be similarly arranged in place of mini D-Sub connector 134. Computer module 101, for example, can be a module that conforms to VPX/VITA 46 standard and that has a 3U form factor.

Faceplate 116 of computer module 101 has two adjacent apertures 256, 258 aligned along the width direction x of faceplate 116. In the particular example shown in FIG. 11, top aperture 256 is sized to receive a USB receptacle 132 and bottom aperture 258 is sized to receive a mini D-Sub connector 134. Interfaces 126 of the USB receptacle 132 and mini D-Sub connector 134 are to be inserted into apertures 256, 258 from the inboard side of the faceplate 116. Interfaces 126 of the USB receptacle and the mini D-Sub connector are accessible from the outboard side of the faceplate 116 through apertures 256, 258. For example, a user can insert a USB plug 256 (not shown) into USB receptacle 132 at the outboard side of faceplate 116 through top aperture 256.

Figure 9:
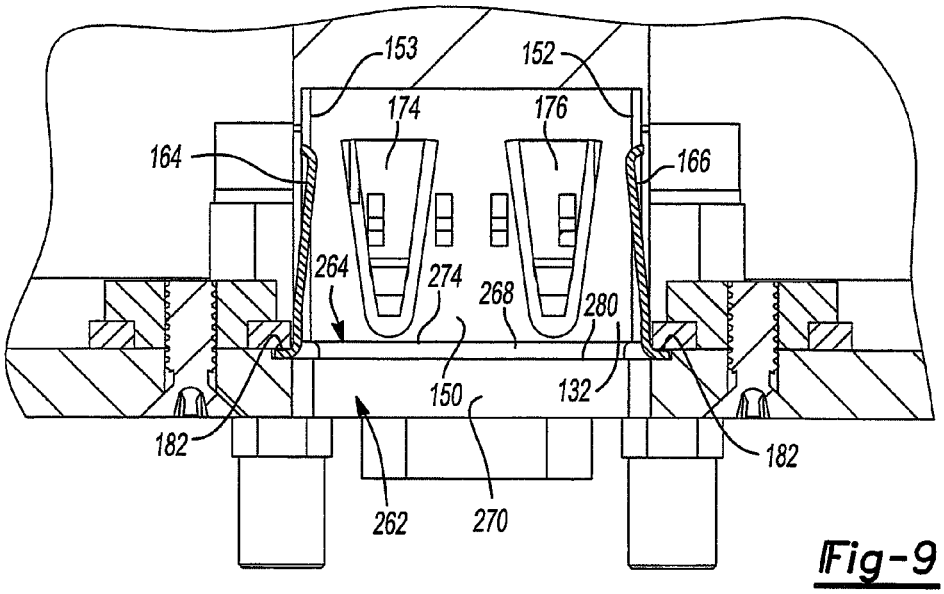
FIG. 9 depicts a view along the line 9-9 of FIG. 7.
Figure 10:
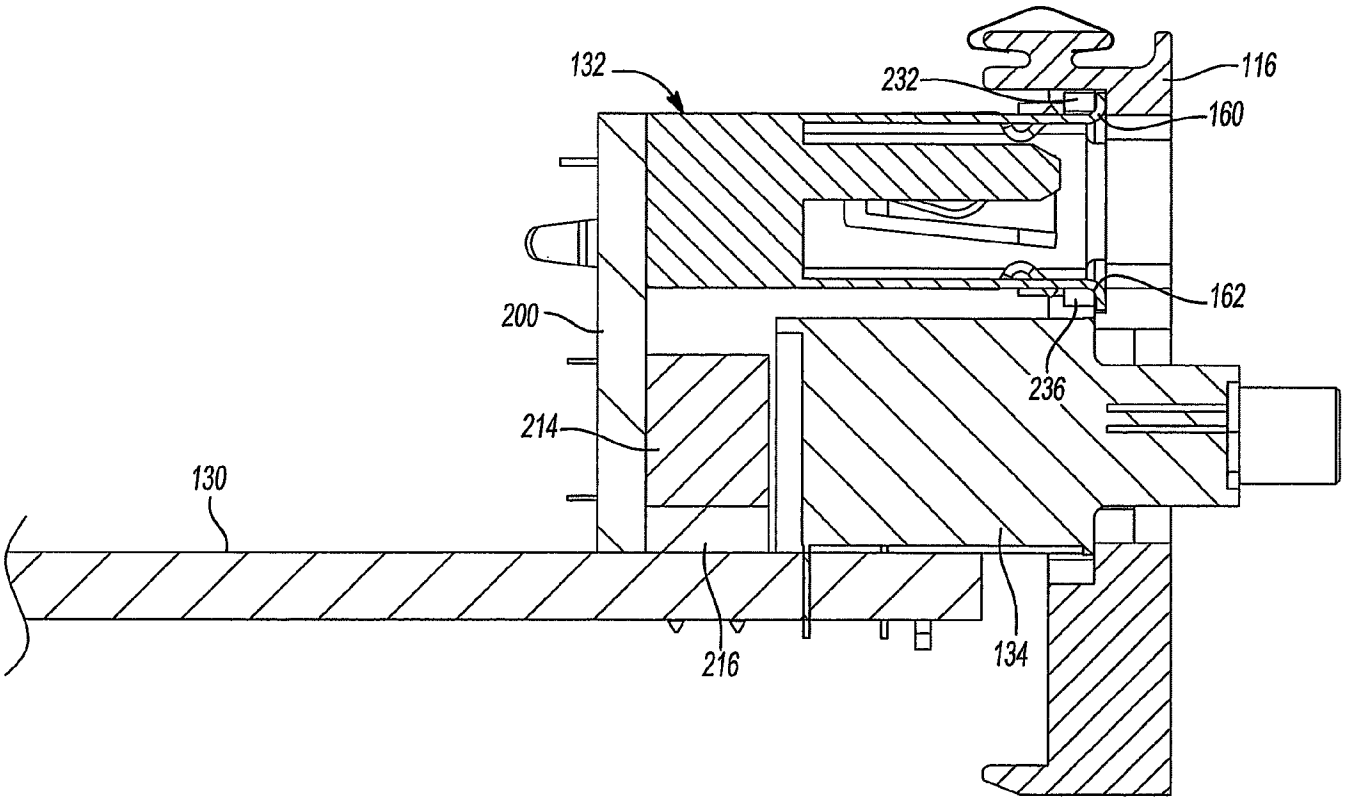
FIG. 10 depicts a view along the line 10-10 of FIG. 7.
Figure 11:
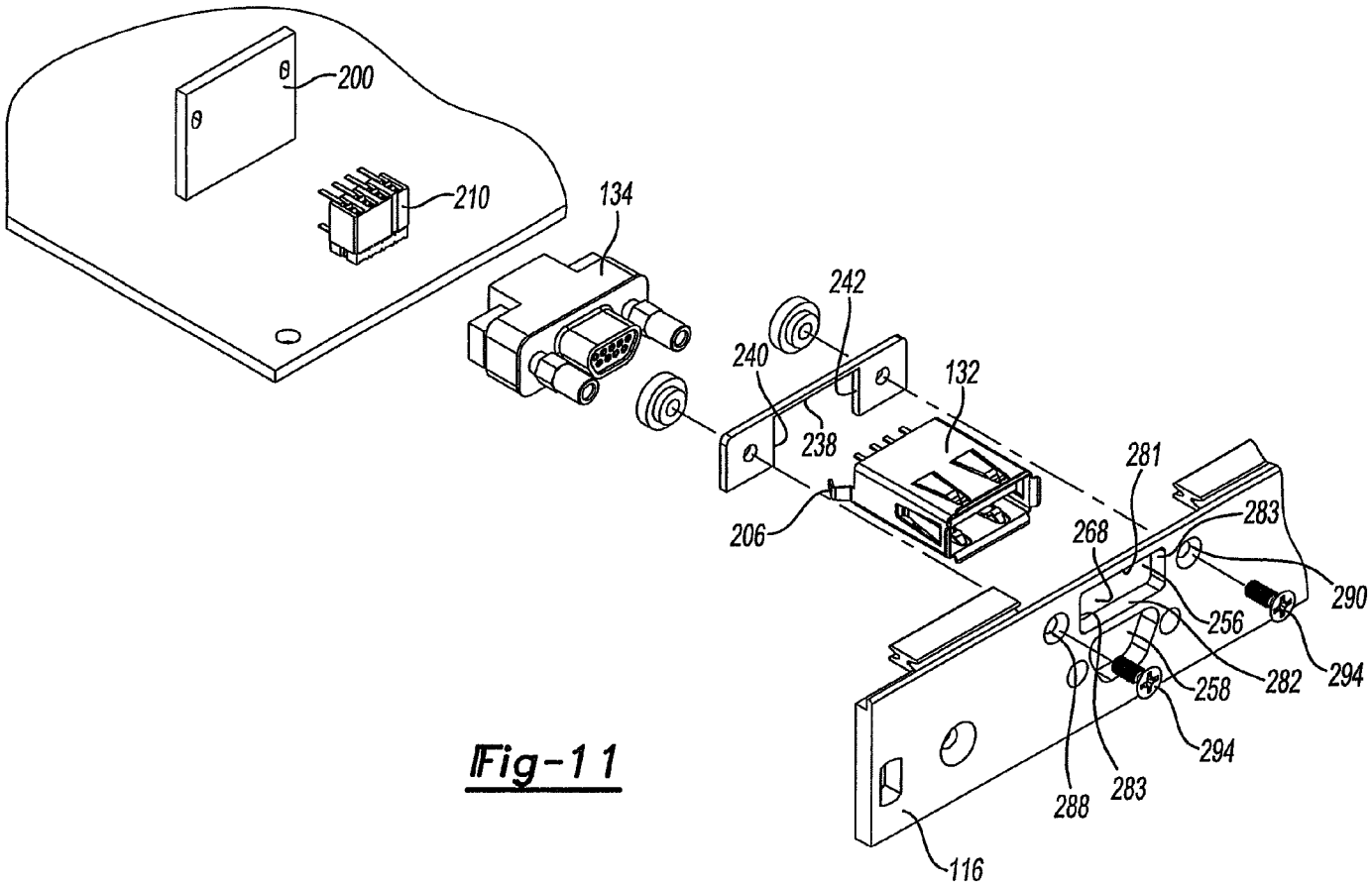
FIG. 11 depicts another exploded view of a USB receptacle assembly according to certain embodiments of the disclosure.

As shown in FIGS. 9-11, top aperture 256 includes outboard portion 262 and inboard portion 264 that are generally coaxial. Each of outboard portion 262 and inboard portion 264 generally defines respective rectangular open areas 268, 270. Open area 270 defined by outboard portion 262 is smaller than open area 268 of inboard portion 264. Open area 270 defined by the outboard portion 262 allows a USB plug to be inserted into the USB connector from the outboard side of faceplate 116. Open area 268 defined by the inboard portion 264 allows the outboard end 142 of the USB receptacle to be inserted into the inboard portion 264 from the inboard side of faceplate 116. A surface 280 is formed in faceplate 116 at the connecting part of the outboard portion and the inboard portion to form rectangular retention wall 274. Retention wall 274 surrounds open area 270 defined by the outboard portion 262 and generally has a width larger than the width of planar part 278 of flanges 160, 162, 164, 166. When outboard end 142 of USB receptacle 132 is pushed into inboard portion 264, outboard faces 180 of the respective four flanges 160, 162, 164, 166 can be placed against retention wall 274. Retention wall 274 prevents the USB receptacle 132 from being pushed through aperture 256 in an outboard direction. Inboard portion 264 has a depth that allows flanges 160, 162, 164, 166 to be recessed into the inboard portion 264. When retention bracket 230 is placed against faceplate 116, flanges 160, 162, 164, 166 are retained by retention bracket 230. This restricts movement of USB receptacle 132 in a direction z perpendicular to faceplate 116.

A top wall, a bottom wall, and two side walls in faceplate 116 define respective top, bottom, and two side surfaces of the open area 268 of the inboard portion 264. The open area 268 of the inboard portion 264 can be slightly larger than the face area of the outboard end 142, including flanges 160, 162, 164, 166, of the USB receptacle 132. When the USB receptacle 132 is inserted into inboard portion 264, the top wall, bottom wall, and two side walls may engage with the edge portions of the flanges 160, 162, 164, 166 and generally restrict the planar movement of USB receptacle 132 in the inboard portion 264. Bores 288, 290 are formed in faceplate 116 to each side of top aperture 256. Bores 288, 290 on retention bracket 230 and respective bores 246, 248 are coaxially aligned.

Flanges 160, 162, 164, 166 of outboard end 142 of USB receptacle 132 are inserted into inboard portion 264 of top aperture 256. Flanges 160, 162, 164, 166 of USB receptacle 132 are placed in proximity to retention wall 274 in top aperture 256. Flanges 160, 162, 164, 166 recess into inboard portion 264, and the outer edge portions of flanges 160, 162, 164, 166 engage with the corresponding adjacent top wall 281, bottom wall 282, or side walls 283, in top aperture 256. Retention bracket 230 is placed in proximity to outboard end 142 of USB receptacle 132. Edge portions of top 232 and side portions 234, 236 of the retention bracket engage with at least portions of respective top wall 148, and two lateral walls 152, 153 of the USB receptacle 132. Outboard face 244 of the retention bracket 230 is placed against the inboard face of faceplate 116. Retention bracket 230 engages at least portions of flanges 160, 162, 164, 166. Each bore 246, 248 on retention bracket 230 is aligned to respective bores 288, 290 on the faceplate. A pair of fasteners 294 are inserted into each pair of aligned bores to securely fasten retention bracket 230 to faceplate 116. Examples of fasteners include threaded fasteners and rivets. Movement of flanges 160, 162, 164, 166, and consequently USB receptacle 132, is restricted in a direction z perpendicular to faceplate 116 by retention bracket 230 and retention wall 274. Movement of flanges 160, 162, 164, 166, and consequently USB receptacle 132, is restricted in a planar direction of faceplate 116 by the top, bottom, or side walls 280 in top aperture 256. Retention wall 274, side walls 280, and retention bracket 230 sufficiently constrain the movement of flanges 160, 162, 164, 166 and consequently movement of the USB receptacle 132.

USB receptacle 132 is attached to riser 200 in the manner described above. Riser 200 is attached to circuit board 114 through board connector 210 in the manner described above. A second connector 134 is coupled to circuit board 114 and placed in space 224 defined by USB receptacle 132, riser 200, circuit board 114, and faceplate 116. Referring to FIGS. 10-12, the second connector is mini D-Sub connector 134. The outboard end of mini D-Sub connector 134 is inserted into bottom aperture 258 of the faceplate. The interface 126 of mini D-Sub connector 134 is exposed to users through bottom aperture 258. Computer module 101 shown in FIGS. 10-14 can conform to the VPX/VITA 46 standard.

Figure 13:
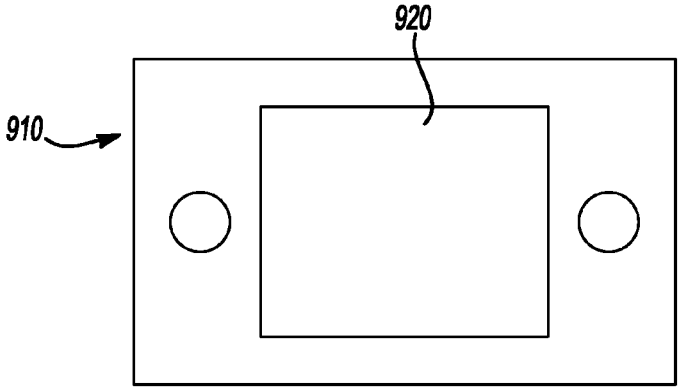
FIG. 13 depicts a retention bracket in accordance with certain embodiments of the disclosure.

FIG. 13 depicts another retention bracket 910 in accordance with certain embodiments. Retention bracket 910 has a generally rectangular aperture 920 in a central area. USB receptacle 132 can be inserted into aperture 920 from its inboard end 140. Aperture 920 has dimensions generally corresponding to the width and height of the USB receptacle 132. Outboard faces 244 of the top, bottom, and two side portions of the retention bracket engage with the inboard faces 182 of the top, bottom, and two lateral flanges, respectively. Thus, flanges 160, 162, 164, 166 of the USB receptacle prevent the USB receptacle from passing through the retention bracket 920.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A Universal Serial Bus (USB) receptacle assembly comprising:

a USB receptacle including a first end, a second end opposite the first end, and a USB interface located at the first end;

a riser coupled to the second end of the USB receptacle and generally perpendicular to a long axis of the USB receptacle; and a board connector coupled to the riser and in electrical communication with the USB receptacle.

2. The USB receptacle assembly of claim 1, wherein the riser has a height that is shorter than a VPX width.

3. The USB receptacle assembly of claim 1, wherein the board connector is coupled to a circuit board.

4. The USB receptacle assembly of claim 3, wherein the board connector includes a header connector and a socket connector.

5. The USB receptacle assembly of claim 1, wherein the USB receptacle includes a first flange disposed at the first end, wherein the USB receptacle assembly further includes a retention bracket engaging the USB receptacle and positioned inboard of and adjacent to the first flange.

6. The USB receptacle assembly of claim 5, wherein the retention bracket is planar and has a top portion connecting first and second side portions, wherein the top and the first and second side portions define a rectangular open area, wherein the rectangular open area receives the USB receptacle to be positioned in the open area and that retains the flange.

7. The USB receptacle assembly of claim 1, wherein the USB receptacle further includes second and third flanges disposed at the first end, wherein the first, second, third flanges each are attached to respective outer walls of the USB receptacle and extend outwardly away from the USB receptacle.

8. A computer board assembly comprising:

a circuit board having connectors located at an inboard end of the circuit board and configured to be coupled to a slot of backplane;

a Universal Serial Bus (USB) receptacle having a first end, a second end opposite the first end, and a USB interface including a first flange disposed at the first end;

a riser coupled to the second end of the USB receptacle at a first end of the riser;

a board connector coupled to an outboard end of the circuit board and a second end of the riser, the board connector electrically communicating with the USB receptacle and the circuit board;

an electrically conductive element coupled to the circuit board and positioned between the USB receptacle and the circuit board; and a retention bracket engaging the USB receptacle and positioned inboard of and adjacent to the flange.

9. The computer board assembly of claim 8, wherein the riser is perpendicular to the circuit board.

10. The computer board assembly of claim 8, wherein the electrically conductive element is a mini D-Sub connector.

11. The computer board assembly of claim 8, wherein the USB receptacle is positioned within a VPX width from the circuit board.

12. The computer board assembly of claim 8, wherein the board connector includes a header connector and a socket connector.

13. The USB receptacle assembly of claim 8, wherein the retention bracket is planar and has a top portion connecting first and second side portions, wherein the top and the first and second side portions define a rectangular open area, wherein the rectangular open area receives the USB receptacle to be positioned in the open area and that retains the flange.

14. A computer module comprising:

a circuit board;

a faceplate coupled to the circuit board, the faceplate having first and second adjacent apertures positioned along a width of the faceplate;

a Universal Serial Bus (USB) receptacle having a first end and a second end, wherein a USB interface and a first flange are disposed in proximity to the first end;

a riser coupled to the second end of the USB receptacle at the first end;

a board connector coupled to the circuit board and a second end of the riser, the board connector being in electrical communication with the USB receptacle and the circuit board;

an input/output (I/O) connector coupled to the circuit board and positioned between the USB receptacle and the circuit board, a portion of the I/O connector being placed in the second aperture;

a retention bracket; and a fastener, wherein a portion of the flange is placed generally within the first aperture, the retention bracket engages the USB receptacle and is arranged adjacent to an inboard face of the faceplate and covers a portion of the first aperture, the retention bracket and the first aperture restricting movement of the flange, the fastener secures the retention bracket to the faceplate.

15. The computer module of claim 14, wherein the riser is perpendicular to the circuit board.

16. The computer module of claim 14, wherein the I/O connector is a mini D-Sub connector.

17. The computer module of claim 14, wherein the USB receptacle and the I/O connector is positioned within a VPX width from the circuit board.

18. The computer module of claim 14, wherein the computer module is a board in compliance with VPX specification.

19. The computer module of claim 14, wherein the board connector includes a header connector and a socket connector.

20. The USB receptacle assembly of claim 14, wherein the retention bracket is planar and has a top portion connecting first and second side portions, wherein the top and the first and second side portions define a rectangular open area, wherein the rectangular open area receives the USB receptacle to be positioned in the open area and that retains the flange.

21. A multi-service platform system comprising:

a chassis;

a backplane having a plurality of slots located at an inboard end of the chassis;

a computer module configured to be plugged into one of the plurality of slots, the computer module including:

a circuit board;

a faceplate coupled to the circuit board, the faceplate having first and second adjacent apertures positioned along a width of the faceplate;

a Universal Serial Bus (USB) receptacle having a first end and a second end, wherein a USB interface and a flange are disposed in proximity to the first end;

a riser coupled to the second end of the USB receptacle at the first end;

a board connector coupled to the circuit board and a second end of the riser, the board connector being in electrical communication with the USB receptacle and the circuit board;

an input/output (I/O) connector coupled to the circuit board and positioned between the USB receptacle and the circuit board, a portion of the I/O connector being placed in the second aperture;

a retention bracket; and a fastener, wherein a portion of the flange is placed generally within the first aperture, the retention bracket engages the USB receptacle and is arranged adjacent to an inboard face of the faceplate and covers a portion of the first aperture, the retention bracket and the first aperture restricting movement of the flange, the fastener secures the retention bracket to the faceplate.

22. The multi-service platform system of claim 21, wherein the multi-service platform system is a system in compliance with VPX specification.

* * * * *